US006023858A

United States Patent [19]

Srourian

[11] Patent Number: 6,023,858

[45] Date of Patent: Feb. 15, 2000

[54] TWO-PIECE SHOE BOTTOM SYSTEM

[75] Inventor: Nichan Srourian, Studio City, Calif.

[73] Assignee: Reflections Shoe Corp., Sun Valley, Calif.

[21] Appl. No.: 09/076,275

[22] Filed: May 12, 1998

[51] Int. Cl.[7] ..... A43B 21/36; A43B 21/437; A43B 21/52

[52] U.S. Cl. ..... 36/42; 36/11.5; 36/36 R; 36/24.5

[58] Field of Search ..... 36/11.5, 36 R, 36/36 C, 41, 42, 39, 24.5, 100

[56] References Cited

U.S. PATENT DOCUMENTS

| | | | |
|---|---|---|---|
| 1,235,324 | 7/1917 | Kimber | 36/34 R |
| 1,347,883 | 7/1920 | Wedein et al. | 36/41 |
| 2,037,613 | 4/1936 | Book | 36/42 |
| 2,165,427 | 7/1939 | Vigorith et al. . | |
| 2,303,431 | 12/1942 | Brophy . | |
| 2,912,772 | 11/1959 | Harrison . | |
| 3,514,879 | 6/1970 | Frattallone | 36/42 |
| 4,073,074 | 2/1978 | Rabin et al. . | |
| 4,198,769 | 4/1980 | Rigon . | |
| 4,219,946 | 9/1980 | Baum | 36/42 |
| 4,244,070 | 1/1981 | Ughi . | |
| 4,272,897 | 6/1981 | Ponce | 36/24.5 |
| 4,400,893 | 8/1983 | Musci | 36/24.5 |
| 4,805,320 | 2/1989 | Goldenberg et al. | 36/42 |
| 4,848,008 | 7/1989 | Kuehnle et al. | 36/35 R |
| 5,079,857 | 1/1992 | Clifton | 36/42 |
| 5,524,365 | 6/1996 | Goldenberg | 36/42 |

FOREIGN PATENT DOCUMENTS

| | | | |
|---|---|---|---|
| 555776 | of 0000 | Belgium . | |
| 1168711 | of 0000 | France . | |
| 1400923 | of 0000 | France . | |
| 917910 | of 0000 | France . | |
| 2087708 | 6/1982 | United Kingdom | 36/42 |

*Primary Examiner*—Paul T. Sewell
*Assistant Examiner*—Anthony Stashick
*Attorney, Agent, or Firm*—Thomas I. Rozsa; Tony D. Chen; Jerry Fong

[57] ABSTRACT

A two-piece shoe bottom system including a platform structure and a hollow interchangeable heel structure. The platform structure comprises a lower forepart portion, a raised rear heel portion, and a middle wedge portion connecting the forepart portion to the raised rear heel portion. The raised rear heel portion is elevated substantially above the forepart portion so that it will correspond to a particular height of the interchangeable heel structure. A reinforcing bolt member is molded to the underside of the raised heel portion of the platform structure. The hollow interchangeable heel structure is detachably attached to the reinforcing bolt member.

16 Claims, 4 Drawing Sheets

TWO-PIECE SHOE BOTTOM SYSTEM

BACKGROUND OF THE INVENTION

1. Field of the Invention

The present invention generally relates to the field of design and construction of shoes. More particularly, the present invention relates to a two-piece shoe bottom system for general footwear.

2. Description of the Prior Art

A shoe is generally comprised of an upper, an insole or midsole, and a sole. The upper comes in contact with the foot of a user and may be made of leather straps, synthetic material or cloth, and is commonly called a sandal. The upper also may be made to cover the whole foot and is commonly called a pump, moccasin or boot. The insole is the part of the shoe upon which the foot rests thereon. The sole is part of the shoe which comes in contact with the ground. The function of the sole is to withstand abrasion, be flexible, and comfortable.

Typically, in the construction of a shoe, the sole can be attached to the insole by adhesive means, while the heel has to be nailed to a very structurally strong insole. In addition, the insole also provides another function for holding firmly together the platform and the heel portions of the sole. Therefore, it is specially made to provide a body to the shoe having the function of serving as the backbone in the structure.

High heel shoes are generally constructed of high heel soles. A high heel sole typically consists of a forward toe portion and a raised heel portion. An insole overlies the upper side of the sole and is suitably sealed and secured thereto in a conventional manner. The high heel is then attached to the raised heel portion of the sole by conventional means.

One of the problems in constructing the prior art high heel shoes is that they often have very complicated structures. This often increases the manufacturing costs. Another problem with prior art high heel shoes is that they are not durable. Oftentimes the high heel is made of plastic which can break easily and also has problems such as nails coming off. In most prior art design and construction of the shoe, the high heel is directly attached to the raised heel portion of the sole of the shoe. Therefore, the strength and durability of the attachment is limited by the properties of the materials being used for the construction of the heel and the sole of the shoe.

The following ten (10) prior art patents are found to be pertinent to the field of the present invention:

1. U.S. Pat. No. 2,165,427 issued to Vigorith et al. on Jul. 11, 1939 for "Shoe Sole and Heel Construction" (hereafter the "Vigorith Patent");
2. U.S. Pat. No. 2,303,431 issued to Brophy on Dec. 1, 1942 for "Shoe And Shoe Bottom Unit" (hereafter the "Brophy Patent");
3. U.S. Pat. No. 2,912,772 issued to Harrison on Nov. 17, 1959 for "Shoe Structure Having Molded Basic Units" (hereafter the "Harrison Patent");
4. U.S. Pat. No. 4,073,074 issued to Rabin et al. on Feb. 14, 1978 for "Ladies Shoe Construction" (hereafter the "Rabin Patent");
5. U.S. Pat. No. 4,198,769 issued to Rigon on Apr. 22, 1980 for "Boots Of Injection Molded Plastic" (hereafter the "Rigon Patent");
6. U.S. Pat. No. 4,244,070 issued to Ughi on Jan. 13, 1981 for "Sole With Heel For Women Footwears Or Shoes, And Method For Quickly And Economically Making Said Soles With Corresponding Heels" (hereafter the "Ughi Patent");
7. Belgium Patent No. 555,776 (hereafter the "Belgium Patent");
8. French Patent No. 917,910 (hereafter the "'910 French Patent");
9. French Patent No. 1,168,711 (hereafter the '711 French Patent"); and
10. French Patent No. 1,400,932 (hereafter the "'932 French Patent").

The Vigorith Patent discloses a shoe sole and heel construction. It comprises a sole with a rear portion for attachment to a heel. The rear portion has an anchoring portion with a recess for receiving a tongue which is attached to the heel. The tongue is permanently affixed to the recess for securing the heel to the sole. The Vigorith Patent does not teach an interchangeable heel.

The Brophy Patent discloses a shoe and shoe bottom unit. It comprises a high heel portion, and a shank portion which is integral with the heel portion and extends forwardly and downwardly from the upper part of the heel portion to form a flat sole-attaching face. A sole is attached to the face of the shank portion by cement. The Brophy Patent does not teach an interchangeable heel.

The Harrison Patent discloses a shoe structure having molded basic units. It comprises a basic sole unit and a unitary heel and shank unit. The basic sole unit has a bottom heel area, a forepart sole area, and an intervening shank area merged with the bottom heel area and with the forepart sole area. The unitary heel and shank unit is affixed to the bottom heel area and the intervening shank area respectively. The Harrison Patent does not tech an interchangeable heel.

The Rabin Patent discloses ladies shoe construction. It comprises a heel, an outsole, an insole, a filler, a liner, and an upper. The Rabin Patent does not teach an interchangeable heel.

The Rigon Patent discloses boots of injection molded plastic. It comprises a reinforced arch and heel construction to which a reinforced insole member is formed in a single piece with a rigid heel portion.

The Ughi Patent discloses a sole with heel for women's footwear or shoes, and method for quickly and economically making said soles with corresponding heels. The Ughi Patent does not teach an interchangeable heel.

The Belgium Patent, as disclosed from the figures shows a heel portion, a shank portion, and a forepart portion, wherein the shank portion is affixed to the top of the heel portion and the forepart portion is affixed to the lower end of the shank portion.

The '910 French Patent, as disclosed from the figures shows a shank portion affixed to a heel assembly.

The '711 French Patent, as disclosed from the figures shows a three-piece shoe unit.

The '932 Patent, as disclosed form the figures shows a two-piece shoe unit.

It is highly desirable to design and construct a shoe bottom system which is easy to handle, durable and inexpensive to manufacture. It is desirable to have a very efficient and also very effective design and construction of a two-piece shoe bottom system to overcome the problems of the prior art. It is also desirable to provide a two-piece design of a shoe bottom system with interchangeable heels with the capability of rapidly and effortlessly interchanging different heels.

SUMMARY OF THE INVENTION

The present invention is a unique two-piece shoe bottom system which comprises a platform structure and an interchangeable heel structure. The platform structure comprises a lower forepart portion, a raised rear heel portion, and a middle wedge portion connecting the forepart portion to the raised rear heel portion, where the raised rear heel portion is elevated substantially above the forepart portion so that it will correspond to a particular height of the interchangeable heel structure. The interchangeable heel structure may be generally a hollow cylindrical shaped body that is tapered downwardly from a wide top end to a narrow bottom end. An elongated reinforcing bolt member is integrally formed to the underside of the raised heel portion of the platform structure, wherein the reinforcing bolt member is threadedly engaged with the interchangeable heel structure to secure the same thereto.

It is known that the heel of a shoe, particularly a high heel of a woman's shoe, is the part that is most likely to be damaged, and repairing a shoe with a damaged heel is often very expensive. However, with an interchangeable heel, if the heel is damaged, then the heel can be simply replaced with a new heel, and the shoe can be worn again. Furthermore, by having interchangeable heels, heels with different shapes or colors can be chosen and interchanged by a wearer. In this way, the same shoe can be used with heels with different shapes or colors, and this feature thereby eliminates the necessity of having a plurality of shoes with different heels.

It is therefore an object of the present invention to provide a two-piece shoe bottom system which comprises a platform structure and an interchangeable heel structure which is detachably attached to the platform structure.

It is also an object of the present invention to provide a two-piece shoe bottom system which comprises a platform structure and an interchangeable heel, with the capability of rapidly interchanging alternative heel structures with different shapes and colors.

It is a further object of the present invention to provide an elongated reinforcing bolt member which is affixed to a heel portion of a platform structure and extends downwardly to secure an interchangeable heel structure thereto.

In the preferred embodiment of the present invention, the two-piece shoe bottom system comprises a platform structure and a corresponding interchangeable heel structure. The platform structure has a low or thin forepart portion, a raised heel portion, and a reinforcing bolt member which extends downwardly from the heel portion, wherein the interchangeable heel structure is connected to the elongated reinforcing bolt member.

In an alternative embodiment of the present invention, the two-piece shoe bottom system comprises a platform structure and a corresponding interchangeable heel structure. The platform structure has a high or thick forepart portion, a raised heel portion, and a reinforcing bolt member which extends downwardly from the heel portion, wherein the interchangeable heel structure is connected to the reinforcing bolt member.

The present invention provides a simple yet effective connection between the platform structure and the interchangeable heel structure. The connecting bolt member also provides an effective reinforcement to the strength of the high heel.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is a two-piece shoe bottom system which comprises essentially a platform structure and an interchangeable heel structure to form part of a shoe. To completely assemble the shoe, the shoe may also include an upper, an insole and a sole.

Figure 1:
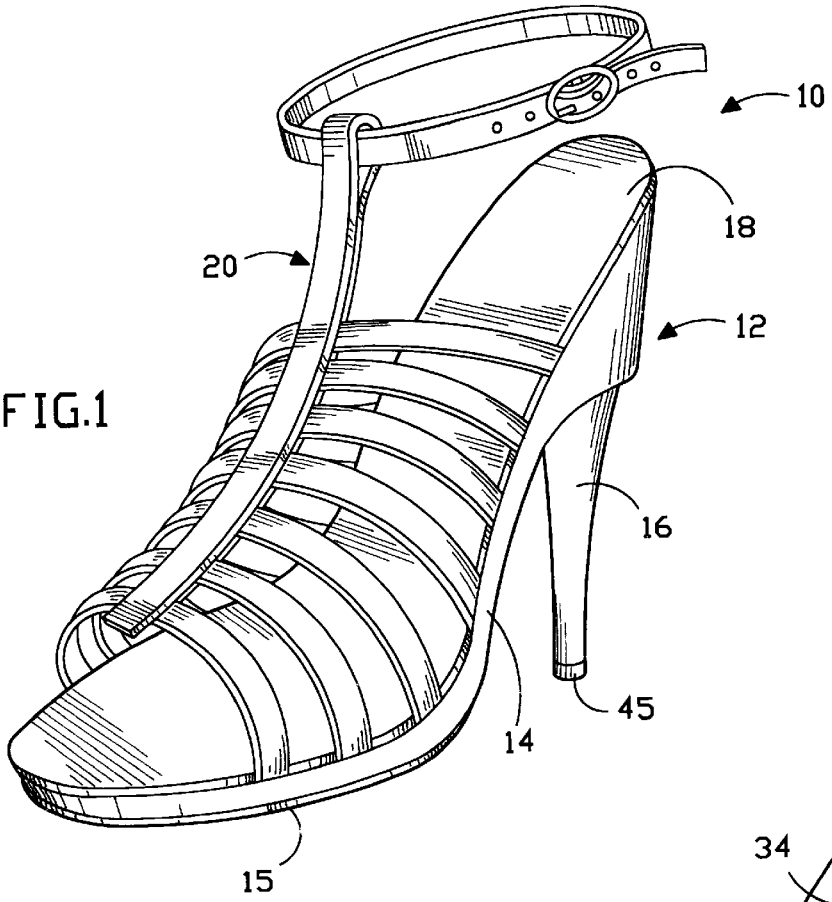
FIG. 1 is a perspective view of an assembled shoe utilizing the present invention two-piece shoe bottom system.

Referring to FIG. 1, there is depicted at 10 an assembled left woman's shoe utilizing the present invention two-piece shoe bottom system 12. The present invention two-piece shoe bottom system 12 comprises a platform structure 14 and an interchangeable high heel structure 16. The assembled shoe 10 may further comprise an insole 18 which overlies on top of the platform structure 14, leather straps or upper 20 secured between the insole 18 and the platform structure 14 for securing a user's foot to the shoe 10, and an outsole 15 which contacts the ground for protecting the bottom of the platform structure.

Figure 2:
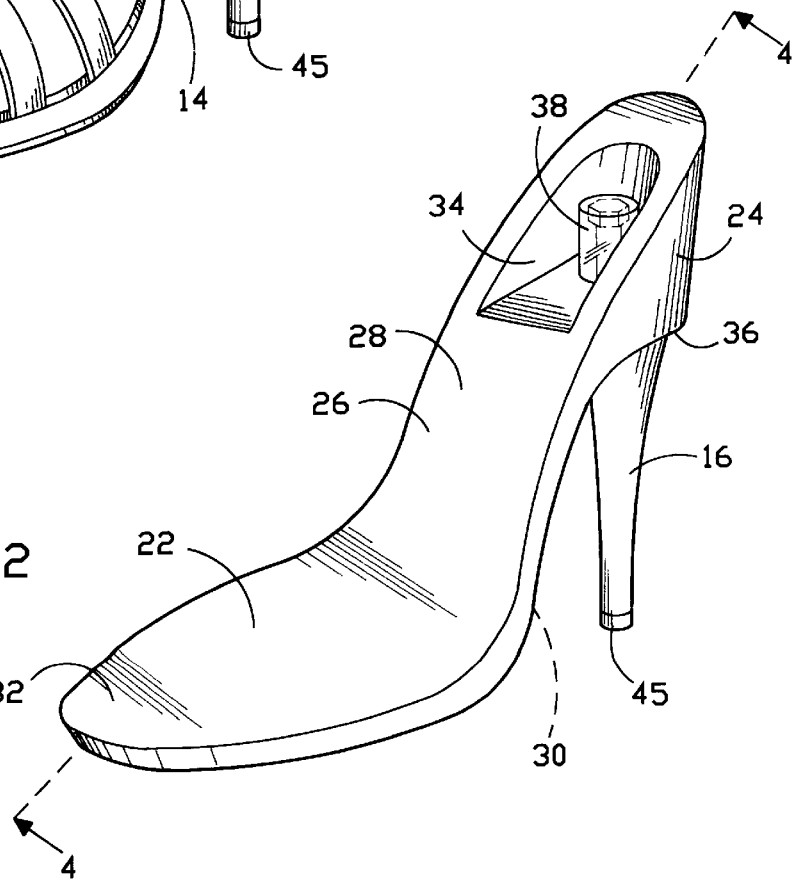
FIG. 2 is a perspective view of one preferred embodiment of the present invention two-piece shoe bottom system.
Figure 3:
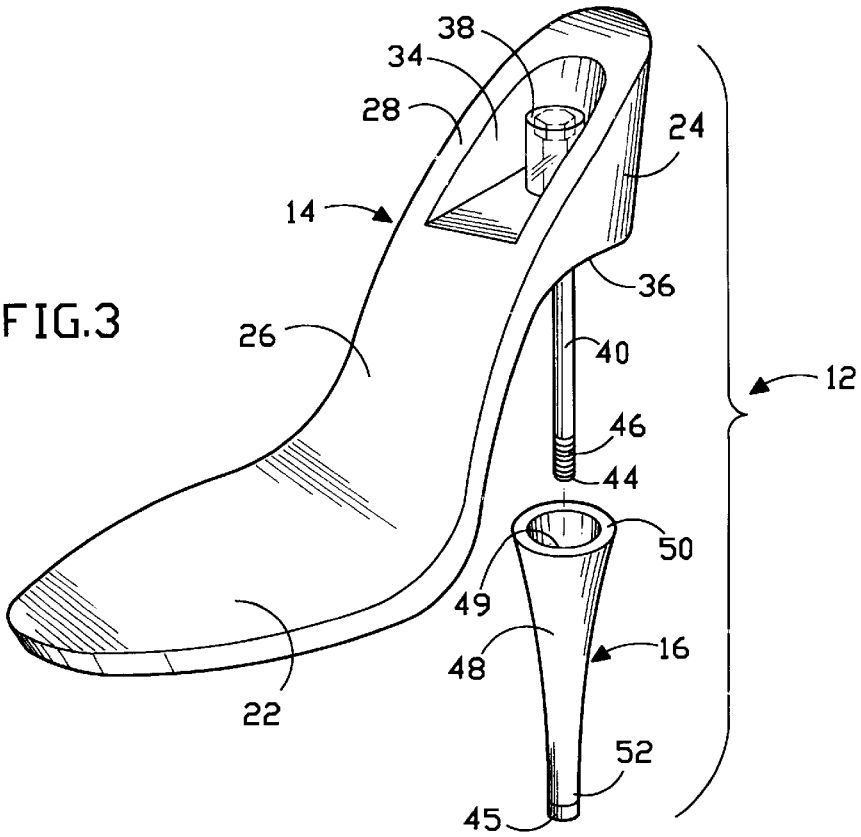
FIG. 3 is an exploded perspective view of the two-piece shoe bottom system shown in FIG. 2.
Figure 4:
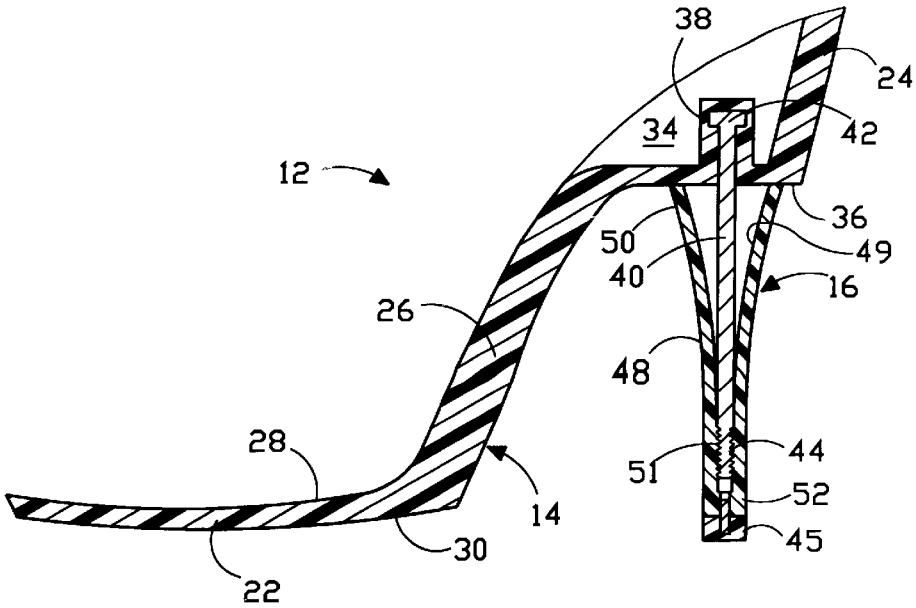
FIG. 4 is a cross-sectional view taken along line 4—4 of FIG. 2.

FIG. 2 depicts a perspective view of the preferred embodiment of the present invention two-piece shoe bottom system 12. FIG. 3 depicts a perspective exploded view of the two-piece shoe bottom system 12 shown in FIG. 2. FIG. 4 depicts a cross-sectional view of the two-piece shoe bottom system 12 shown in FIG. 2. Referring to FIGS. 2, 3 and 4, the platform structure 14 comprises a lower or thin bottom forepart portion 22, a raised rear heel portion 24, and a middle wedge portion 26 which extends upwardly from the end of the forepart portion 22 to the beginning of the raised heel portion 24. The platform structure 14 further has an upper side 28 and an underside 30.

The lower forepart portion 22 is substantially horizontal and parallel to the ground. The lower forepart portion 22 further has a toe area 32. The raised heel portion 24 has a sunken closed recess 34 which is provided on the upper side 28 of the platform structure 14 for reducing the weight of the platform structure 14, and a flat horizontal underside 36. A hollow protruding attachment hub 38 is integrally formed thereto and extends upwardly from the sunken closed recess 34 and located below the upper side 28 of the platform structure 14.

An elongated reinforcing bolt member 40 is provided with the present invention two-piece shoe bottom system 12. The reinforcing bolt member 40 has a widened upper head end 42, a lower end 44, and threads 46 located adjacent to the lower end 44, where the widened upper head end 42 is integrally molded to the protruding attachment hub 38 from the underside 36. It will be appreciated that the widened upper head end 42 may be attached by other suitable means.

The high heel structure 16 has a generally tapered cylindrical shaped elongated body 48 with a wide top end 50 and a narrow bottom end 52. The elongated body 48 has a hollow bore 49 with interior threads 51 near the bottom end 52 for adopting and engaging with the bolt member 40. A top-lift 45 may be used with the high heel structure 16 and is affixed to the bottom end 52. The high heel structure 16 is detachably attached to the platform structure 14 by inserting the reinforcing bolt member 40 into the hollow body 48 of the high heel structure 16, where the threads 46 are threadedly engaged with the thread 51 on the interior surface of the high heel structure 16. The hollow body 48 is rotated clockwise or counter-clockwise, depending on the threads, such that the wide end 50 abuts against the flat underside 36 of the raised heel portion 24 of the platform structure 14.

The present invention conforms to conventional forms of manufacture, and is of simple construction and is easy to use. The two-piece shoe bottom system 12 can be made from several materials. The manufacturing process which could accommodate the construction of the two-piece shoe bottom system 12 may be injection molding, thermoforming, etc. or other molding process. By way of example, the platform structure 14 and the interchangeable heel structure 16 can be made of plastic material, for example, poly carbonate plastic, ABS plastic or nylon plastic. The molding and mass production process would enable the shoe to be produced inexpensively.

Figure 5:
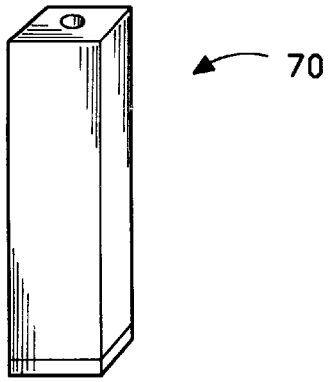
FIG. 5 is a perspective view of an alternative design of the interchangeable heel structure of the present invention two-piece shoe bottom system.
Figure 6:
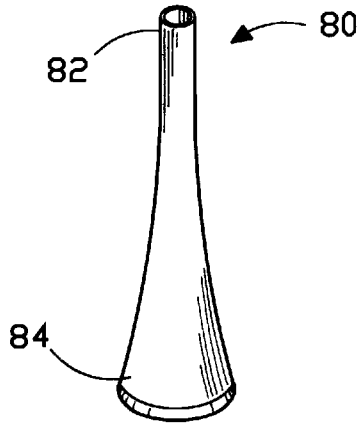
FIG. 6 is a perspective view of another alternative design of the interchangeable heel structure of the present invention two-piece shoe bottom system.
Figure 7:
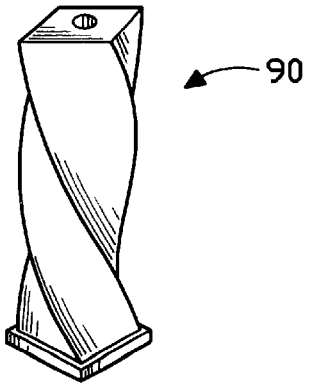
FIG. 7 is a perspective view of still another alternative design of the interchangeable heel structure of the present invention two-piece shoe bottom system.

FIGS. 1 through 4 have depicted an interchangeable high heel structure 16 that has a cylindrical tapered body. It will be appreciated that the interchangeable heel structure can include several different shaped heel structures, for example, a square shaped heel structure 70 as shown in FIG. 5, a cylindrical reverse-tapered heel structure 80 having a narrow top end portion 82 and a wide bottom end portion 84 as shown in FIG. 6, and a spiral shaped heel structure 90 as shown in FIG. 7. It will be also appreciated that the interchangeable heel structure may have different colors.

Figure 8:
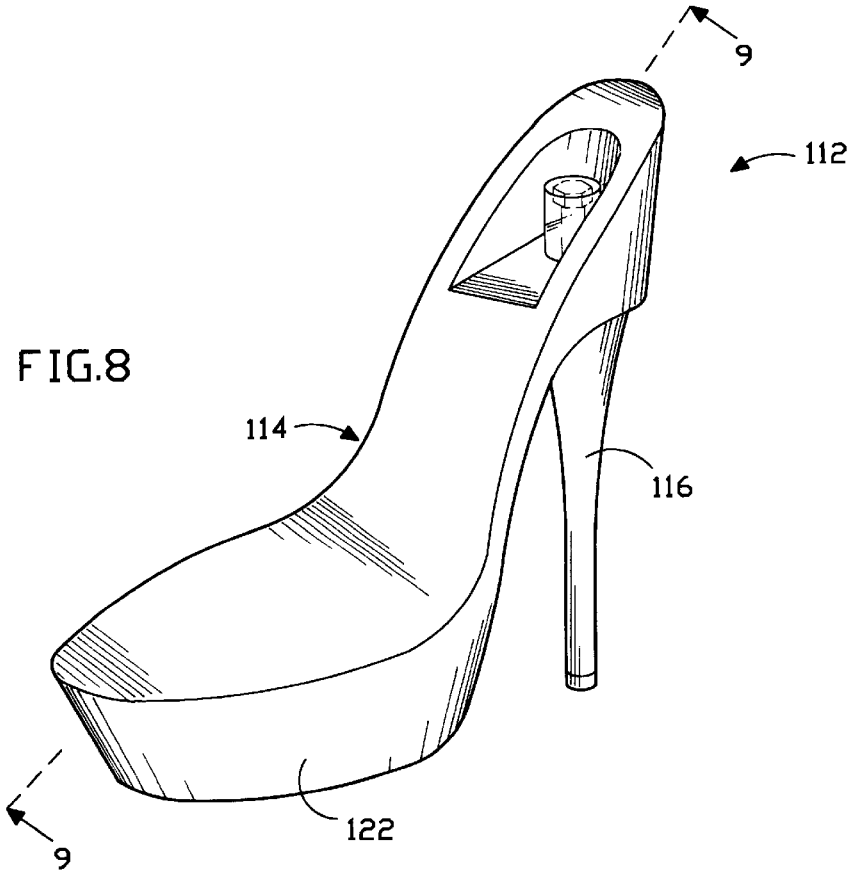
FIG. 8 is a perspective view of another preferred embodiment of the present invention two-piece shoe bottom system.
Figure 9:
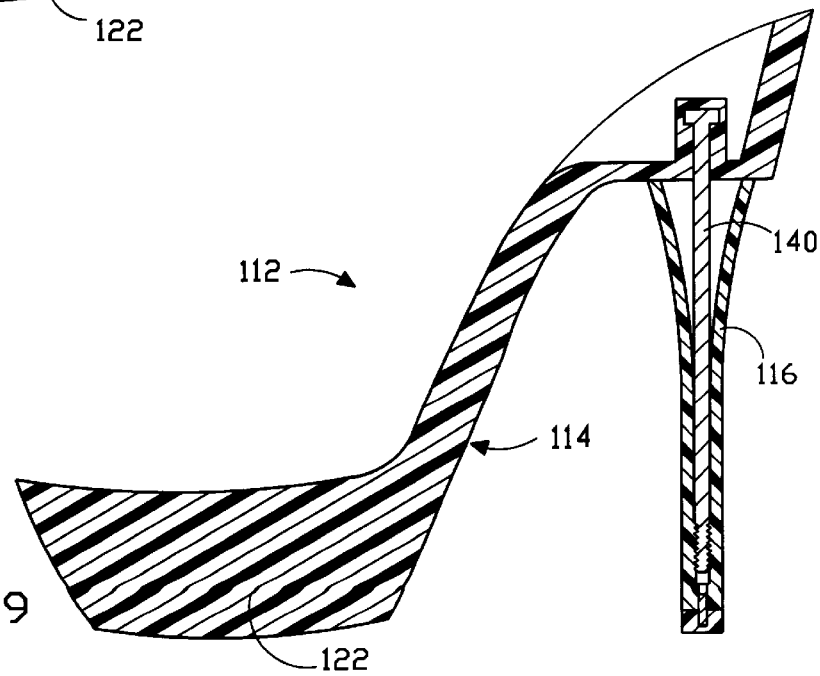
FIG. 9 is a cross-sectional view taken along 9—9 of FIG. 8.

Referring to FIGS. 8 and 9, there are depicted at 112 another preferred embodiment of the present invention two-piece shoe bottom system which comprises a platform structure 114 and a very elongated interchangeable high heel structure 116. The two-piece shoe bottom system 112 assembles and functions the same as previously described above except that the platform structure 114 now has a thicker or higher forepart portion 122 and an extra long reinforcing bolt member 140 to accommodate an extra high heel structure 116. Therefore, the platform structure 114, the reinforcing bolt member 140, and the interchangeable heel structure 116 used in this embodiment are very similar to the ones previously described in FIGS. 1 through 4, and the description thereof will not be repeated.

Defined in detail, the present invention is a shoe bottom system, comprising: (a) a platform structure having a lower forepart portion, a raised rear heel portion, and a wedge middle portion interconnecting the forepart and raised heel portions, the raised heel portion having an upper side with a closed recess, a flat horizontal underside, and a hub extending upwardly from the underside into the recess; (b) an elongated reinforcing bolt member having a widened top end and an opposite bottom end with exterior threads thereon, the widened top end integrally formed with the hub of the raised heel portion and extending downwardly from the underside; and (c) an interchangeable high heel structure having an elongated body with a top end, a bottom end, and a hollow bore having interior threads adjacent the bottom end for adapting to the exterior threads on the reinforcing bolt member for securely attaching the interchangeable high heel structure to the reinforcing bolt member, such that the top end of the interchangeable high heel structure abuts against the underside of the raised heel portion of the platform structure, and the interchangeable heel structure can be removed by unscrewing the elongated reinforcing bolt member from the interchangeable high heel structure.

Defined broadly, the present invention is a shoe bottom system, comprising: (a) a platform structure having a forepart portion, a raised heel portion, and a middle portion interconnecting the forepart and raised heel portions, the raised heel portion having a bottom side; (b) a reinforcing bolt member formed with the raised heel portion of the platform structure and extending downwardly from the bottom side, the reinforcing bolt member including attaching means; and (c) an interchangeable heel structure having a hollow bore for receiving the reinforcing bolt member and having means for detachably attaching the interchangeable heel structure to the attaching means of the reinforcing bolt member.

Defined more broadly, the present invention is a show bottom system, comprising: (a) a platform having a raised heel portion with a bottom side; (b) a bolt formed with the raised heel portion of the platform and extending downwardly from the bottom side, the bolt including attaching means; and (c) an interchangeable heel having means for receiving the bolt and having means for detachably attaching the interchangeable heel to the attaching means of the bolt.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A shoe bottom system, comprising:

a. a platform structure having a lower forepart portion, a raised rear heel portion, and a wedge middle portion interconnecting the forepart and raised heel portions, the raised heel portion having an upper side with a closed recess, a flat horizontal underside, and a hub extending upwardly from the underside into the recess;

b. an elongated reinforcing bolt member having a widened top end and an opposite bottom end with exterior threads thereon, the widened top end integrally formed with said hub of said raised heel portion and extending downwardly from said underside; and c. an interchangeable high heel structure having an elongated body with a top end, a bottom end, and a hollow bore having interior threads adjacent the bottom end for adapting said exterior threads on said reinforcing bolt member for securely attaching the interchangeable high heel structure to said reinforcing bolt member, such that the top end of the interchangeable high heel structure abuts against said underside of said raised heel portion of said platform structure and the interchangeable heel structure can be removed by unscrewing said elongated reinforcing bolt member from the interchangeable high heel structure.

2. The shoe bottom system in accordance with claim 1 further comprising a lift attached to said bottom end of said interchangeable heel structure for withstanding abrasion.

3. The shoe bottom system in accordance with claim 1 wherein said interchangeable heel structure is made of poly carbonate plastic material.

4. The shoe bottom system in accordance with claim 1 wherein said platform structure is made of poly carbonate plastic material.

5. The shoe bottom system in accordance with claim 1 wherein said interchangeable heel structure includes a generally tapered cylindrical body having a wide top end and a narrow bottom end.

6. The shoe bottom system in accordance with claim 1 wherein said interchangeable heel structure includes a generally tapered cylindrical body having a narrow top end and a wide bottom end.

7. The shoe bottom system in accordance with claim 1 wherein said interchangeable heel structure includes a generally spiral square shaped body.

8. The shoe bottom system in accordance with claim 1 wherein said interchangeable heel structure includes a generally square shaped body.

9. A shoe bottom system, comprising:

a. a platform structure having a lower forepart portion, a raised rear heel portion, and a wedge middle portion interconnecting the forepart and raised heel portions, the raised heel portion having an upper side with a closed recess, a flat horizontal underside, and a hub extending upwardly from the underside into the recess;

b. an elongated reinforcing bolt member having a widened top end and an opposite bottom end with exterior threads thereon, the widened top end integrally formed with said hub of said raised heel portion and extending downwardly from said underside; and c. an interchangeable high heel structure having an elongated body with a top end, a bottom end, and a hollow bore for adapting said exterior threads on said reinforcing bolt member for securely attaching the interchangeable high heel structure to said reinforcing bolt member, such that the top end of the interchangeable high heel structure abuts against said underside of said raised heel portion of said platform structure and the interchangeable heel structure can be removed by unscrewing said elongated reinforcing bolt member from the interchangeable high heel structure.

10. The shoe bottom system in accordance with claim 9 further comprising a lift attached to said bottom end of said interchangeable heel structure for withstanding abrasion.

11. The shoe bottom system in accordance with claim 9 wherein said interchangeable heel structure is made of poly carbonate plastic material.

12. The shoe bottom system in accordance with claim 9 wherein said platform structure is made of poly carbonate plastic material.

13. The shoe bottom system in accordance with claim 9 wherein said interchangeable heel structure includes a generally tapered cylindrical body having a wide top end and a narrow bottom end.

14. The shoe bottom system in accordance with claim 9 wherein said interchangeable heel structure includes a generally tapered cylindrical body having a narrow top end and a wide bottom end.

15. The shoe bottom system in accordance with claim 9 wherein said interchangeable heel structure includes a generally spiral square shaped body.

16. The shoe bottom system in accordance with claim 9 wherein said interchangeable heel structure includes a generally square shaped body.

* * * * *